United States Patent [19]

Berlad et al.

[11] 4,091,592

[45] May 30, 1978

[54] LOW HEAT TRANSFER, HIGH STRENGTH WINDOW MATERIALS

[75] Inventors: Abraham L. Berlad, Stony Brook; Francis J. Salzano, Patchogue; John E. Batey, Stony Brook, all of N.Y.

[73] Assignee: The United States of America as represented by the United States Department of Energy, Washington, D.C.

[21] Appl. No.: 792,173

[22] Filed: Apr. 29, 1977

[51] Int. Cl.[2] ..... E04C 2/34

[52] U.S. Cl. ..... 52/616; 52/304

[58] Field of Search ..... 52/616, 304, 171, 473; 49/74, 76, 77; 98/121 R, 121 A

[56] References Cited

U.S. PATENT DOCUMENTS

| | | | |
|---|---|---|---|
| 2,695,430 | 11/1954 | Wakefield | 52/616 X |
| 2,745,150 | 5/1956 | Warns | 52/616 X |
| 2,849,762 | 9/1958 | McCarthy | 52/616 |
| 2,976,583 | 3/1961 | McCarthy | 52/616 X |
| 2,991,697 | 7/1961 | Vetere | 49/77 X |
| 3,022,549 | 2/1962 | Cummings | 52/616 X |
| 3,642,557 | 2/1972 | Warp | 52/616 X |

*Primary Examiner*—J. Karl Bell

*Attorney, Agent, or Firm*—Dean E. Carlson; Leonard Belkin

[57] ABSTRACT

A multi-pane window with improved insulating qualities; comprising a plurality of transparent or translucent panes held in an essentially parallel, spaced-apart relationship by a frame. Between at least one pair of panes is a convection defeating means comprising an array of parallel slats or cells so designed as to prevent convection currents from developing in the space between the two panes. The convection defeating structures may have reflective surfaces so as to improve the collection and transmittance of the incident radiant energy. These same means may be used to control (increase or decrease) the transmittance of solar energy as well as to decouple the radiative transfer between the interior surfaces of the transparent panes.

12 Claims, 8 Drawing Figures

LOW HEAT TRANSFER, HIGH STRENGTH WINDOW MATERIALS

BACKGROUND OF THE INVENTION

This invention was made during the course of, or under a contract with, the U.S. Energy Research and Development Administration.

This invention relates to passive devices for the collection of radiant heat, and more particularly to improved devices for utilizing the well-known "greenhouse effect".

The most successful devices of this sort in the prior art have comprised two or more parallel panes of glass, or some similar material, separated by a dead air space so as to reduce conductive heat loss. However, if the dead air space is more than a certain width, which can be calculated approximately according to well-known principles of heat flow, free convection currents will arise. Thus beyond a certain width there is no improvement in the insulating effect.

It is also known in the prior art to fill the dead air space with an insulating material, such as styrofoam beads, at night or during cloudy weather and to remove the beads during periods of sunshine. Such a device, however, is relatively complex and free convection currents would still arise while heat was being collected, reducing its net effectiveness. It is also known in the prior art to enclose a shade of the venetian blind type between panes of glass or plastic. Such a device is intended to prevent the accumulation of dust and dirt on the enclosed blind and is not designed to prevent free convection currents, nor are the surfaces and their reflectivities so selected as to improve the collection of radiant heat while providing for the defeat of convection and ordinary radiative losses. Also, an ordinary venetian blind allows free convection currents to develop when closed if the space between panes is large.

SUMMARY OF THE INVENTION

This invention substantially overcomes the problems described above by means of a window effective in permitting the passage of radiant energy while reducing unwanted heat flow due to convection which comprises a plurality of coextensive panes of a material substantially transparent to radiant energy at frequencies above the infra red region, a frame means holding said panes in a spaced apart essentially parallel relationship and forming a space there between and convection defeating means dividing the space between at least one pair of said panes into spaces sufficiently small to prevent the development of free convection currents. The latter in a suitable configuration consists of slats, having an approximately rectangular form, which are spaced from and parallel to each other being wide enough to essentially span the distance between the panes and supported by the frame members at both ends of the enclosed space. The slats can be flat, or have a curved or chevron shaped cross-section along their width.

In an alternative configuration there could be two sets of slats side by side like venetian blinds. The slats of each set could be oriented at an angle to each other when it is desired to block visibility through the window or they would be oriented parallel to each other to allow maximum radiant heat transfer.

In another embodiment the flat slats could be provided with hinged flap-like elements which can be raised for maximum privacy or to block reradiation of heat and lowered for maximum radiant heat transfer.

In another embodiment the convection defeating means could have the form of an array of contiguous cells. The array may be bonded to the panes in order to provide a window with significant structural strength. In such an embodiment the panes would preferably be formed of transparent or translucent plastic.

In all the embodiments of this invention the surface of the connection defeating means may be made reflective in order to improve the transmittance of radiant energy.

It is thus a principle object of this invention to provide a window effective to transmit radiant energy and having improved insulating characteristics.

Other objectives and advantages of the invention will become apparent from the following description of preferred embodiments.

BRIEF DESCRIPTION OF THE DRAWINGS

FIGS. 1 and 2 show a preferred embodiment of the invention wherein the convection defeating means comprises essentially rectangular horizontal slats. Window 10 consists of a rectangular frame 12 supporting a pair of panes 14 which are held in an essentially parallel and spaced-apart relationship by the frame 12 which encloses the space between the panes. The panes 14 are formed of a material, such as glass, which transmits radiant energy at frequencies above the infrared. The horizontal slats 18 are held in a spaced apart, essentially parallel relationship, between the panes 14 with their minor axis essentially perpendicular to the panes, by the frame 12. The horizontal orientation of the slats 18 is preferred but the slats may be rotated about the minor axis at any angle with respect to the horizontal. By minor axis herein is meant the axis along the smaller dimension of the approximately rectangular slats.

The spacing of the slats 18 shown by the dimension (d) must be sufficiently small to prevent the development of free convection currents. By spacing herein is meant the perpendicular distance between adjacent slats. This dimension can be calculated approximately using the following expression for the Rayliegh number, taken from Ekert and Drake, "Heat and Mass Transfer". Published by McGraw Hill Book Co. 1959 (Second Edition) Chapter 10, where it is expressed in equivalent form as the product of the Prandtl and Grashoff numbers, as $$R = \frac{c\, d^3 \rho\, g\, \beta\, \Delta T}{k\, \nu} \qquad (1)$$

R is the Rayliegh number and is dimensionless. (Prandtl number × Grashoff number.)

$c$ is the specific heat capacity of the gas enclosed in the window.

$d$ is approximately the smallest dimension of the space of interest.

$\rho$ is the density of the gas enclosed in the window.

$g$ is the acceleration due to gravity.

$\beta$ is the coefficient of thermal expansion of the gas.

$k$ is the thermal conductivity of the gas enclosed in the window.

$\nu$ is the kinematic viscosity of the gas enclosed within the window.

$\Delta T$ is the design temperature difference, measured at the inner surface of the panes.

In the application of the preceding mathematical expression, R must be less than approximately 1000. It can be seen that the Rayliegh number can be made to be zero by choosing $d$ equal to zero. At the same time the maximum transmittance of energy is obtained when there is no convection defeating means. In the design of a suitable window of a given thickness for a given design temperature difference the approximate value for $d$ necessary to provide improved insulation may be found using the above mathematical expression to compute the value of $d$ giving R equal to 1000. The spacing $d$ may then be somewhat reduced if it should prove necessary to improve the insulating characteristics or somewhat increased if it should prove necessary to improve the transmittance of radiant energy or to reduce cost.

The slats 18 in this embodiment are not load bearing and may be formed of materials without significant structural strength. The product commercially known as Mylar or an equivalent is a preferred material but others such as aluminum foil or paper could be suitable.

Figure 1:
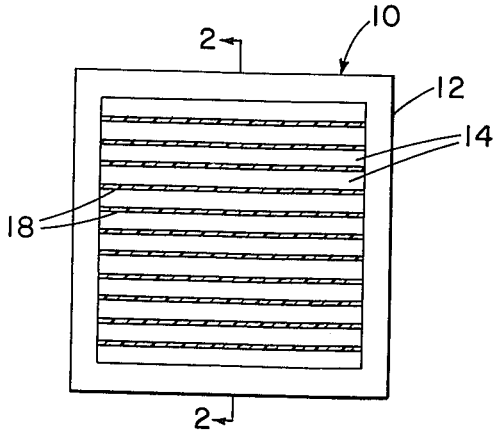
FIG. 1 shows a front elevation view of a preferred embodiment of the invention.
Figure 2:
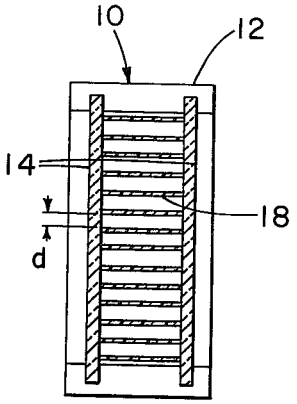
FIG. 2 is a cross-section view along 2—2 of FIG. 1.
Figure 3:
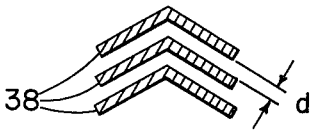
FIG. 3 is a detail cross-section view of the slats an alternative embodiment of the invention.

FIG. 3 shows a modified form of some of the slats 18 of the embodiment of FIGS. 1 and 2. When the embodiment of FIGS. 1 and 2 is modified by incorporating a convection defeating means comprising slats 38 which are bent or curved along the minor axis a new embodiment which provides increased privacy while maintaining good insulating and radiant energy transmitting characteristics is formed. Spacing of the slats 38 as defined by dimension $d$ is measured perpendicular to the modified slats 38 and its value is found which using expression 1 as described above.

Figure 4:
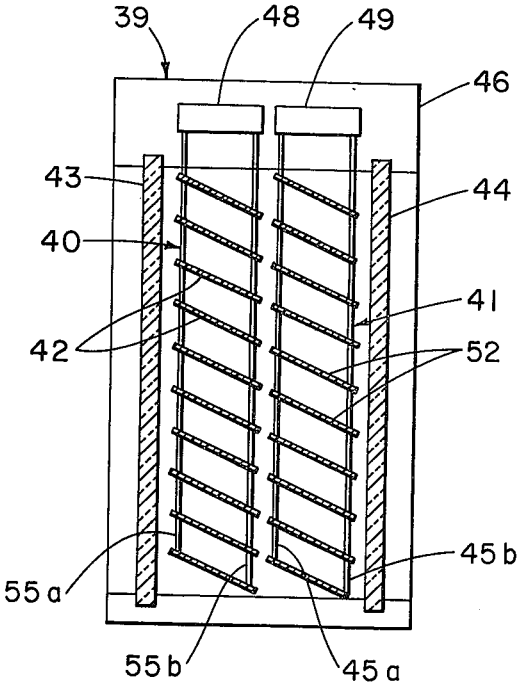
FIG. 4 is a partial cross-section view of another alternative embodiment of the invention.

FIG. 4 shows a preferred embodiment of the invention in which the window 39 has a convection defeating means comprising a pair of venetian blind-like assemblies 40,41 located between the panes 43,44. The latter are formed of materials similar to those described in connection with the embodiment of FIG. 1 and are held in an essentially parallel spaced apart relationship by a frame 46 which encloses the space between the panes 43,44. The venetian blind assemblies 40,41 consist of parallel spaced slats 42,52 which are supported by cords or straps 45,55 which can be utilized as understood in the art to alter the orientation of the slats 42,52. The slats 42,52 of the venetian blind-like assemblies 40,41 are not in contact with the panes 43,44 or the frame 46 but are free to rotate around their major axes in such a manner that a parallel relationship is maintained between the slats of a given venetian blind-like member. Means 48,49 are provided for separately controlling the orientation of the slats of each of the venetian blind-like members 40,41 by raising and/or lowering the cord or straps 45. Such means may be similar to that used in the ordinary venetian blind and may be activated mechanically, electrically, or by such other method as may be suitable. Means may also be provided for moving both venetian blind-like assemblies 40,41 so as to allow a substantially unobstructed view through the window and to allow maximum transfer of radiant energy. One of panes 43,44 may be made moveable as to allow access for adjusting assembly 40,41.

There are two modes of using this embodiment of the invention. FIG. 4 shows one mode wherein the slats 42,52 of both venetian blind-like assemblies 40,41 are oriented parallel to the rays of the incoming radiant energy to allow maximum transfer of energy while maintaining good insulating qualities.

Figure 5:
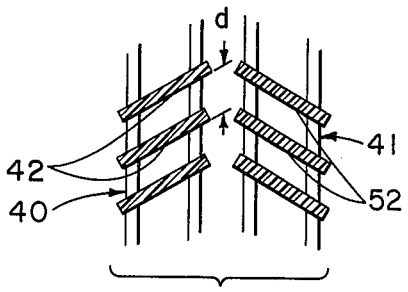
FIG. 5 is a detail of FIG. 4 showing an alternative mode of use.

FIG. 5 shows the embodiment of the invention shown in FIG. 4 when it is being used in the other mode. In this mode the slats 42,52 of each of the venetian blind-like assemblies 40,41 are oriented at an angle with respect to each other so as to provide privacy while allowing good transmission of radiant energy if slats 42,52 have reflective surfaces and maintaining good insulating qualities. If a single such assembly were used it would be necessary to substantially tilt the slats to insure privacy. For windows of more than a certain thickness this would create a space between the edges of the slats and the adjacent pane wherein free convection currents might develop. By using a pair of venetian blind-like assembly having a sufficiently great ratio of slat width to dimension $d$ it is possible for a skilled mechanical designer to design a convection defeating means of this type that may be used as shown in FIG. 5 without creating a space between the panes and adjacent assemblies wide enough for free convection to develop. In this embodiment the dimension $d$ is measured perpendicularly between the slats of the venetian blind-like assemblies 40,41 when they are at their greatest separation, and its value is found as described in the description of the embodiment of FIGS. 1 and 2. As would be obvious to a person skilled in the art this embodiment of the subject invention may alternatively incorporate verticle venetian blind-like assemblies.

Figure 6:
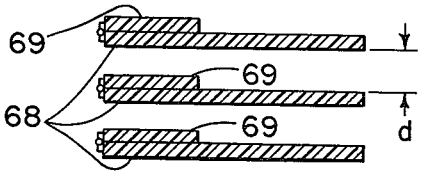
FIG. 6 is a detail cross-section view of the slats in another alternative embodiment of the invention.
Figure 7:
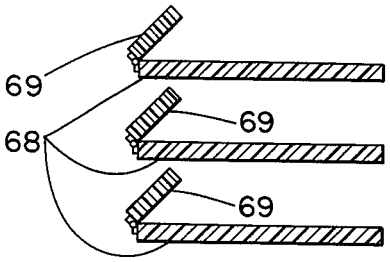
FIG. 7 is similar to FIG. 6 showing an alternative mode of use.

FIGS. 6 and 7 show another modified form of the slats 68 corresponding to the slats 18 of the embodiment shown in FIGS. 1 and 2. When the embodiment of FIGS. 1 and 2 is modified by incorporating a convection defeating structure comprising slats 68 which have a flap-like member 69 flexibly affixed at one edge of the slats and incorporating means (not shown) for raising and lowering the flap-like members 69. A new preferred embodiment which may be operated in either an energy acceptance mode or in a privacy mode is formed. FIG. 6 shows the energy acceptance mode wherein the flap-like members are lowered and lie parallel to and in contact with the slats 68 so as to allow maximal transmittance of radiant energy. FIG. 7 shows the privacy mode wherein the flap-like members are raised cutting off the transmittance of radiant energy and providing privacy. If the flap-like members are made with a reflective inner surface this embodiment will also reduce the loss of heat as radiant energy flowing in the reverse direction.

The critical dimension $d$ is shown in FIG. 6 and is computed as for the embodiment of FIGS. 1 and 2.

Figure 8:
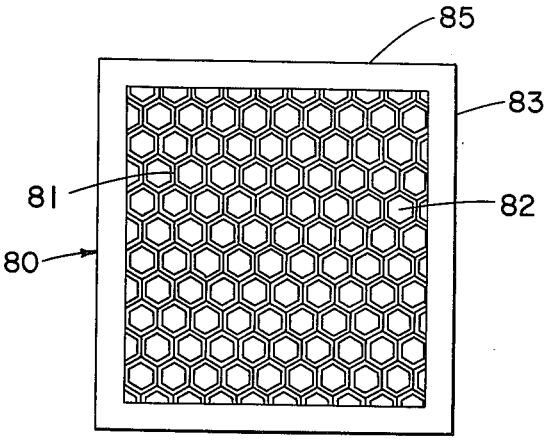
FIG. 8 is a front elevation view of still another alternative embodiment of the invention.

FIG. 8 shows an alternative preferred embodiment where the convection defeating means comprises an array of contiguous cells. Window 80 consists of an array of contiguous cells 81 with the surfaces of the array essentially parallel to the panes 82,83, supported by a frame 89. The panes 82,83 are held in a spaced apart essentially parallel relationship by the frame 85 which encloses the space between the panes. The panes are formed of materials similar to those described in connection with the embodiment shown in FIGS. 1 and 2.

In this embodiment the convection defeating structure may be bonded to the panes so as to provide a window with significant structural strength. In this case the panes 82,83 would be preferably made of a plastic, or some other material resistant to shattering, having the necessary energy transmitting properties.

While in this embodiment hexagonal cells are preferred as forming a window with the greatest strength other cross sections such as rectangular or triangular may be used.

The critical dimension $d$ in this embodiment may be considered to be the diameters of a circle equal in area to the cross section of a cell and its value may be found as described in connection with the embodiment of FIGS. 1 and 2.

In all the embodiments of this invention it is not necessary that the convection defeating means fully span the space between the panes in order to realize the improved insulating qualities of the invention. However, the distance between the convection defeating means and the panes should be much smaller than the critical dimension so that free convection currents cannot develop in that space.

In all the embodiments of this invention the surface of the convection defeating means may be made reflective in order to improve the transmittance of radiant energy. When reflective surfaces are incorporated in the embodiments of FIGS. 4 and 5 and of FIGS. 6 and 7 the embodiments will also suppress unwanted radiant heat exchange when operated in a closed mode.

EXAMPLE: DETERMINATION OF OVERALL U-VALUES FOR COMPOSITE WINDOW MATERIALS

To make initial evaluations of composite window elements (such as those discussed under convection-defeating and radiation-controlling strategies) a set of simple heat transfer experiments have been conducted. These tests involve a styrofoam box which can be internally heated or cooled. One of the six sides of the box is designed to accept a (reduced size of the) composite window element of interest.

The heat transfer process through the window element is expected to be largely one-dimensional, although the heat transfer through the styrofoam box is three-dimensional. In order to analyze, via simple methods, the heat transfer rates through the composite window elements, it is useful to identify a "characteristic dimension" for the box. This is done in terms of a geometric average of the "characteristic dimension" for the inside of the box and the "characteristic dimension" for the outside of the box. The bases for the definition and use of such a characteristic dimension derive from existing analytic solutions for multidimensional heat transfer problems.

We illustrate, for the spherical case: If the test apparatus were a hollow spherical shell (cooled or heated at a steady rate by its interior) then the cooling/heating rate would be given by $$Q_0 = \mp \frac{4\pi k\,(\Delta T)\,(r_a r_b)}{(r_b - r_a)}$$

where $r_1$ = inner radius, $r_b$ = outer radius, $(r_b - r_a)$ = shell thickness, $k$ = thermal conductivity, $(\Delta T)$ = temperature difference between outside and inside surfaces. Thus, the heat transfer rate per unit area, at any value of $r$, is given by:

$$\dot{q}'' = \frac{Q_o}{4\pi r^2} = k(\Delta T)\left[\frac{r_a r_b}{r^2 (r_b - r_a)}\right]$$

If we define $r^*$ = characteristic radius, to be the geometric mean of the two radii:

$$r^* = \sqrt{r_a r_b}$$

then, for $r = r^*$, we have:

$$[\dot{q}''] r^* = k\left[\frac{\Delta T}{r_b - r_a}\right]$$

and, at $r = r^*$, the heat transfer rate per unit area is of the identical algebraic form as that appropriate to one-dimensional, plane parallel plate heat transfer phenomena.

Accordingly, the utilization of the nonone-dimensional styrofoam box to analysis of heat transfer rates through test window elements involves the following:

(1) The interior of the box contains a constant heat source or heat sink.

(2) The test section of the box is fitted tightly with a "styrofoam plug" of construction and material similar to that of the rest of the box.

(3) Subject to constant exterior temperature conditions heat loss by (or heat gain by) the box interior is measured over a substantial time period.

(4) An average heat loss rate per unit area (based on the characteristic dimension of the box) is deduced for the box. A characteristic U-valve for the box is then given directly.

(5) The experiment is repeated, with the composite window element substituted for the "styrofoam plug." Subject to the same internal and external steady state temperature conditions, a new heat transfer rate is determined, for the same substantial time period previously employed.

(6) The characteristic area of the styrofoam box (based on its characteristic dimension) and its previously determined U-value is employed to determine the "box heat loss" for the time period of interest. The remainder of the observed heat loss can be ascribed to the test element. The U-value (and area) of the (wood) frame holding the composite glass element is known. Accordingly, we may then use standard methods to deduce the U-value for the composite window material.

An ab initio set of experiments have been conducted to determine the effective U-values for the test apparatus (styrofoam box with plug) and for a double-glazed (4.0625 inch air gap) window element of the type illustrated in FIGS. 1 and 2. In the latter case, the air gap volume is further divided into a large number of 0.5 inch high regimes, each defined by two glass sides, two wood frame sides, and two 4.0 inch deep sides of 0.001 inch aluminized mylar.

For the no-wind condition, an ambient interior (box) temperature of 0° C and an ambient exterior (box) temperature of 20° C, the following U-values have been determined:

Styrofoam Box: $U \simeq 0.02$ Btu/ft$^2$.hr.° F

Mylar Strung Window: $U \simeq 0.28$ Btu/ft$^2$.hr.° F.

The mylar-strung window tested employed highly reflective (aluminized) 1 mil strips of mylar as convection defeating elements. The convection defeators employed in this (initial) test were not moveable.

What is claimed is:

1. A window effective in permitting the passage of radiant energy there-through while reducing heat flow by way of convection comprising:

(a) a plurality of coextensive panes of a material substantially transparent above the infrared region;

(b) means for holding said panes in a spaced apart essentially parallel relationship and forming a space therebetween; and, (c) convection defeating means between at least one adjacent pair of said panes for dividing the space between said pair of panes into spaces having a critical dimension sufficiently small to prevent the development of free convection currents, for an appropriate set of design conditions, while allowing a maximal transmittance of radiant energy, said convection defeating means essentially spanning the space between said panes.

2. The window as described in claim 1 wherein said convection defeating means has a substantially reflective surface so as to improve the transmission of radiant energy through said window.

3. The window as described in claim 1 wherein said convection defeating means comprises an array of continguous cells spanning the space between said panes, and wherein the critical dimension is considered to be the diameter of a circle having an area equal to the corss sectional area of a cell.

4. The window as described in claim 3 wherein the convection defeating means has a substantially reflective surface so as to improve the transmission of radiant energy through said window.

5. The window of claim 1 in which said convection defeating means comprises slats spaced and parallel to each other whose width extends essentially the full distance between said window panes and whose length extends the full width encompassed by said holding means said slats being spaced sufficiently close to prevent the development of free convection currents.

6. The window of claim 5 wherein said slats are flat.

7. The window of claim 5 wherein said slats have a convex cross-section along their width.

8. The window of claim 5 wherein said slats have reflective surfaces.

9. The window of claim 1 wherein said convection defeating means comprises a pair of arrays of slats spaced and parallel to each other, said arrays each spanning essentially the full width of said holding means and together substantially spanning the full distance between said panes; means for each of said arrays holding said slats in suspension, the latter means including means to vary the attitude of said slats so as to maintain their parallel relationship and so as to assure that the maximum spacing between slats is sufficiently small enough to prevent free convection, said arrays having a ratio of slat width to dimension *d* sufficiently large that they may be used in a privacy mode, without creating a space between said arrays and said panes large enough to allow free convection currents to develop.

10. The window of claim 9 wherein said slats have reflective surfaces.

11. The window of claim 5 wherein said slats are provided with means adjustable between an extended position wherein visibility through said window is blocked and a retracted position wherein there is maximum transmittal of radiant energy.

12. The window of claim 11 wherein said slats and said extendable means have reflective surfaces.

* * * * *